US008243956B2

(12) United States Patent
Turnbull

(10) Patent No.: US 8,243,956 B2
(45) Date of Patent: Aug. 14, 2012

(54) AUTO BIAS MICROPHONE SYSTEM FOR USE WITH MULTIPLE LOADS AND METHOD OF FORMING SAME

(75) Inventor: Robert R. Turnbull, Holland, MI (US)

(73) Assignee: Gentex Corporation, Zeeland, MI (US)

( * ) Notice: Subject to any disclaimer, the term of this patent is extended or adjusted under 35 U.S.C. 154(b) by 1398 days.

(21) Appl. No.: 11/837,563

(22) Filed: Aug. 13, 2007

(65) Prior Publication Data

US 2009/0046870 A1 Feb. 19, 2009

(51) Int. Cl.
*H04R 3/00* (2006.01)

(52) U.S. Cl. ..... 381/95; 381/66; 381/113; 330/265; 330/253; 330/277; 330/297

(58) Field of Classification Search ..... 381/66, 381/113; 330/265, 253, 277, 297, 97, 103, 330/104, 285; 359/838; 379/454
See application file for complete search history.

(56) References Cited

U.S. PATENT DOCUMENTS

| | | | | |
|---|---|---|---|---|
| 5,229,721 | A * | 7/1993 | Stade | 330/265 |
| 5,357,214 | A * | 10/1994 | Heyl et al. | 330/297 |
| 5,577,129 | A * | 11/1996 | Ehara | 381/113 |
| 6,026,162 | A * | 2/2000 | Palett et al. | 379/454 |
| 6,160,450 | A * | 12/2000 | Eschauzier et al. | 330/253 |
| 6,420,975 | B1 | 7/2002 | DeLine et al. | |
| 6,428,172 | B1 * | 8/2002 | Hutzel et al. | 359/838 |
| 6,784,708 | B1 | 8/2004 | Krenzke | |
| 6,873,206 | B1 * | 3/2005 | Hildebrant et al. | 327/560 |
| 7,489,791 | B2 * | 2/2009 | Van Der Zwan et al. | 381/113 |
| 7,899,196 | B2 * | 3/2011 | Furst et al. | 381/111 |
| 2002/0071578 | A1 | 6/2002 | Van Der Zwan et al. | |
| 2008/0226100 | A1 * | 9/2008 | Oddoart et al. | 381/120 |

FOREIGN PATENT DOCUMENTS

WO PCT/US2008/072981 3/2009

* cited by examiner

*Primary Examiner* — Davetta W Goins
*Assistant Examiner* — Kuassi Ganmavo
(74) *Attorney, Agent, or Firm* — Price Heneveld LLP; Scott P. Ryan

(57) ABSTRACT

An autobias vehicular microphone system (300) includes a microphone (301) uses an amplifier (306) for amplifying an output of the microphone. A first feedback path (308) provides an amplifier output signal to the amplifier input for providing amplifier linearity and a second feedback path (305) is used for providing bias to an voltage reference (303). The voltage reference (303) operates to provide an autobias to the amplifier (306) based upon amplifier loading. Thus, a DC feedback loop works as an average voltage sensing circuit operating to center the amplifier (306) to an operating point near one half its supply voltage. By allowing the bias point to vary, a constant clip level can be maintained depending on varying load conditions of electronic devices (307, 309, 311) using the microphone (301).

12 Claims, 2 Drawing Sheets

AUTO BIAS MICROPHONE SYSTEM FOR USE WITH MULTIPLE LOADS AND METHOD OF FORMING SAME

FIELD OF THE INVENTION

The present invention relates generally to vehicular microphones and more particularly to microphones used with multiple electronic devices in a vehicle.

BACKGROUND

Microphones are commonly used in vehicular applications for a variety of purposes. In some applications the microphone is used for cellular telephones, vehicle navigation, safety, and voice recognition systems. A typical prior art microphone system 100 is depicted in FIG. 1, wherein a microphone transducer 101 feeds a gain or amplifier 103 and provides an amplified audio output 105 for an electronic device. One drawback of typical German Association of the Automotive Industry (VDA) microphone vehicular systems occurs when one microphone is used to drive multiple electronic devices. Prior art FIG. 2 illustrates a microphone transducer system 200 where the microphone 201 is connected to the amplification state 203 and then to multiple electronic devices 205, 207, 209 in the vehicle. Those skilled in the art will recognize that the bias point of the microphone will not remain constant when driving multiple devices. Typically electric microphone systems require that the bias remain at a fixed value (typically ½ the supply voltage) which is approximately 4 Volt direct current (VDC) in a VDA system, while the VDA standard dictates an 8 Volt supply voltage and 820 Ohm pull-up resistance for the vehicular microphone. Therefore, paralleling multiple VDA supplies into the microphone 201, will reduce the load resistance which will alter the amplifier bias point. This will ultimately cause a greater degree of clipping and/or other distortion products in the audio from the microphone 201, which is input into one or more electronic devices attached thereto. Prior VDA microphone systems have had to accept reduced performance when connected to multiple loads/inputs or resort to elaborate switching systems to connect the microphone to only one active electronic device input at a time.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
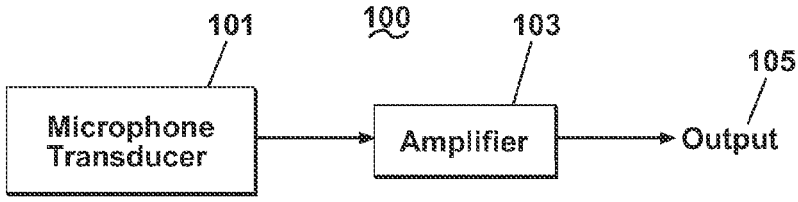
FIG. 1 (PRIOR ART)
FIG. 1 is a prior art block diagram of a typical microphone transducer system using an amplifier stage.
Figure 2:
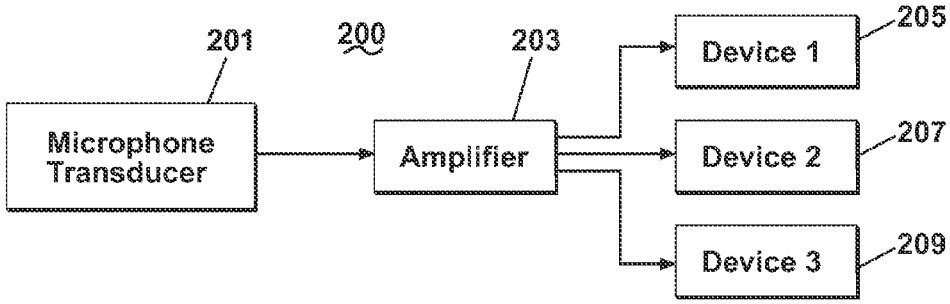
FIG. 2 (PRIOR ART)
FIG. 2 is a prior art block diagram of the microphone transducer system as in FIG. 1 where one microphone is used with a plurality of electronic devices.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to an auto bias microphone system for use with multiple loads. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

It will be appreciated that embodiments of the invention described herein may be comprised of one or more conventional processors and unique stored program instructions that control the one or more processors to implement, in conjunction with certain non-processor circuits, some, most, or all of the functions of an auto bias microphone system for use with multiple loads as described herein. The non-processor circuits may include, but are not limited to, signal drivers, clock circuits, power source circuits, and user input devices. As such, these functions may be interpreted as steps of a method to perform an autobias microphone system for use with multiple loads. Alternatively, some or all functions could be implemented by a state machine that has no stored program instructions or, in one or more application, specific integrated circuits (ASICs), in which each function or some combinations of certain of the functions are implemented as custom logic. Of course, a combination of the two approaches could be used. Thus, methods and means for these functions have been described herein. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

Figure 3:
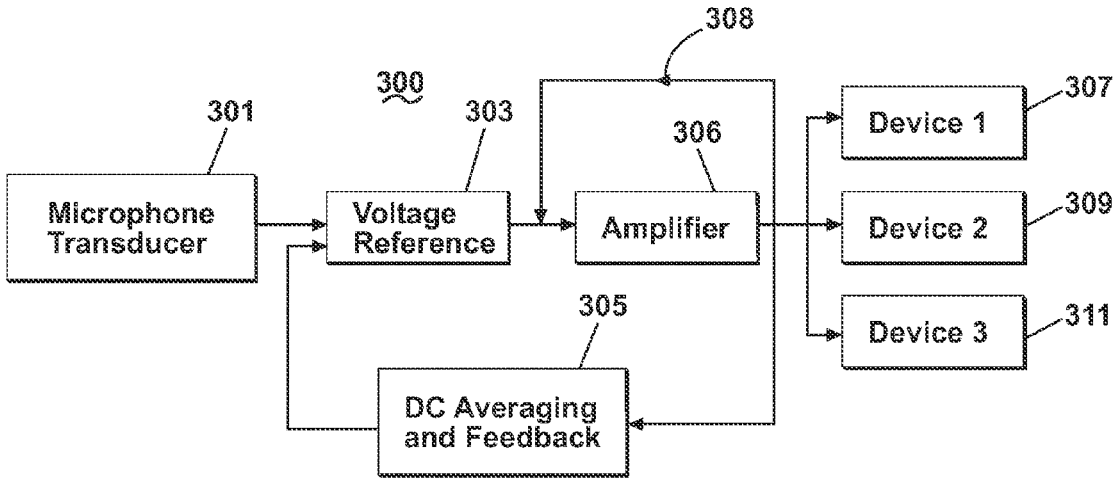
FIG. 3 is a block diagram which illustrates use of a microphone transducer system using DC feedback and averaging.

FIG. 3 illustrates a block diagram of an embodiment of an auto bias microphone system 300 for use with multiple loads. A microphone transducer 301 operates to supply an audio output to a voltage reference stage 303. The voltage reference stage 303 is a programmable voltage reference integrated circuit (IC) that includes an intrinsic offset voltage for setting an average DC output level. Those skilled in the art will recognize that the voltage reference stage 303 uses a three-terminal programmable shunt regulator diode (not shown). This device operates as a low temperature coefficient Zener diode which is programmable from $V_{ref}$ to some predetermined voltage with two external resistors. This device may exhibit a wide operating current range typically from 100 μA to 20 mA with a typical dynamic impedance less than ½ ohm (Ω). The characteristics of this type of voltage reference makes the device an excellent replacement for a Zener diode or bipolar transistor $V_{be}$ in autobias microphone applications. The offset voltage makes it convenient to obtain a stable reference when used with either a positive or negative voltage reference. A direct current (DC) feedback and averaging stage 305 provides negative feedback from the output of the voltage reference stage 303 to an input of the voltage reference stage 303.

An audio amplifier 306 is connected to the output of the voltage reference stage 303 to amplify the output of the microphone transducer 301. Those skilled in the art will also recognize that the audio amplifier 306 utilizes alternating current (AC) feedback to maintain amplifier linearity. A plurality of electronic devices 307, 309, 311 are connected to the output of the audio amplifier 306. Through the use of DC feedback and averaging, the invention operates to allow one transducer or microphone that might be located in a vehicle mirror or other convenient location in a vehicle. In an alternative embodiment, the voltage reference stage 303 can also be used an audio gain stage for reduction in overall parts count to reduce cost.

Figure 4:
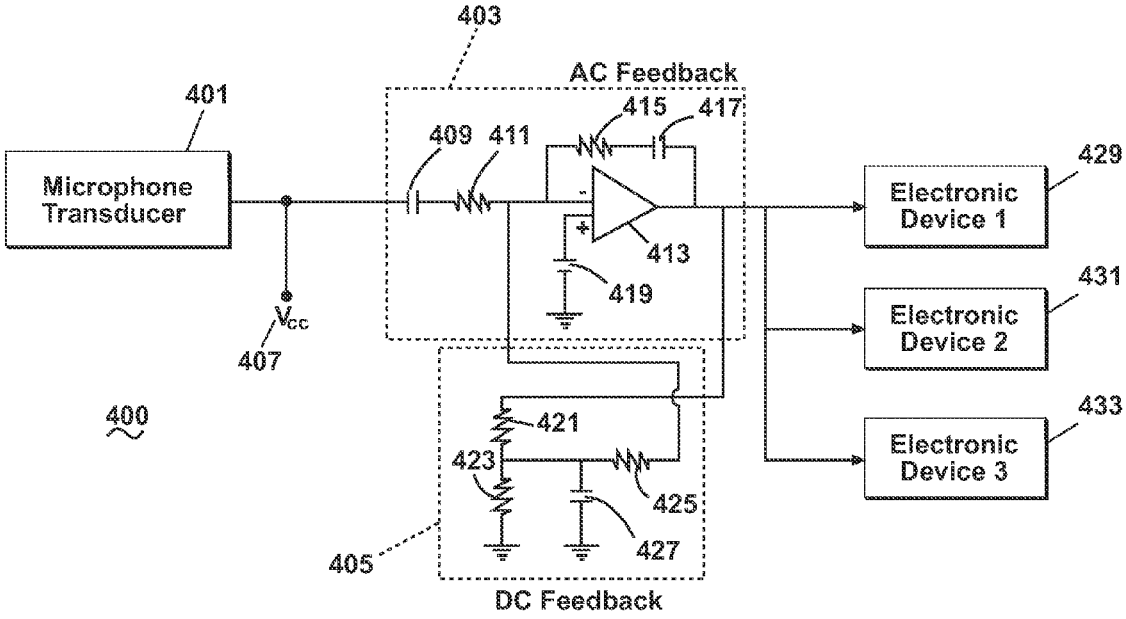
FIG. 4 is a block diagram illustrating an embodiment of that shown in FIG. 3.

FIG. 4 illustrates a block diagram of one specific embodiment of an improved microphone system 400 where the voltage reference and audio gain stage work as one component. As noted in FIG. 3, a microphone transducer 401 is supplied with a supply voltage 407 and provides an audio output of a user voice at some predetermined output level. An audio amplifier 403 is used to increase the signal amplitude from microphone transducer 401. The audio amplifier 403 includes a coupling network including a coupling capacitor 409 and a resistor 411 which supply the correct audio input voltage to a voltage reference/amplifier 413. Those skilled in the art will recognize that the voltage reference/amplifier 413 might be a voltage reference combined with an operational amplifier such as a TLV431 made by Texas Instruments, Inc., a CAT 102 made by Catalyst Semiconductor, Inc., or the like that works to control both the bias and amplify the audio supplied to its input in a linear manner. In order to control the amount of gain of the voltage reference/amplifier 413, a negative feedback loop is used consisting of a resistor 415 and capacitor 417 that couples a predetermined amount of audio or alternating current (AC) feedback from the output of the amplifier 413 to its negative input (−). The positive input (+) of the amplifier 413 generally requires an operating voltage of at least 0.6 Volt DC 419 whose negative node is coupled to ground.

In order to further control the bias point of the voltage reference/amplifier 413 to electronic devices 429, 431, and 433 a direct current (DC) feedback loop 405 is also used from the output of the amplifier 413 to its negative input (−). The DC feedback loop 405 includes a voltage divider consisting of resistors 421, 423 that receives an output voltage from the amplifier 413 and reduce it to a predetermined value. Those skilled in the art will further recognize that under a VDA standard, the voltage divider would typically reduce a 4 Volt DC voltage to 0.6 Volt DC. An isolation resistor 425 is used to isolate an averaging capacitor 427 to average the voltage to a specified value. Thus, the DC feedback loop works as an average voltage sensing circuit operating to center the voltage reference/amplifier 413 to an operating point near one-half its supply voltage. This allows the bias point to vary for maintaining a constant clip level depending on varying load conditions of electronic devices 429-433 using the microphone transducer 401.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

I claim:

1. An autobias vehicular microphone system comprising:
at least one microphone;
an amplifier connected to the at least one microphone for amplifying an output of the at least one microphone;
a first feedback path providing an amplifier output signal to the amplifier input for providing amplifier linearity;
a second feedback path for providing a DC bias to a voltage reference for providing an autobias to the amplifier based upon amplifier loading; and
wherein the autobias provides a variable bias point for the amplifier for maintaining a substantially constant clip level of the amplifier depending on varying load conditions of a plurality of electronic devices using the at least one microphone.

2. An autobias vehicular microphone system as in claim 1, wherein the first feedback path is an audio feedback path.

3. An autobias vehicular microphone system as in claim 1, wherein the second feedback path is a direct current (DC) feedback path.

4. An autobias vehicular microphone system as in claim 1, wherein the second feedback path utilizes at least one voltage divider.

5. An autobias vehicular microphone system as in claim 1, wherein the second feedback path utilizes an averaging capacitor.

6. An autobias vehicular microphone system as in claim 1, wherein the at least one microphone is located in a rear view mirror.

7. A method for providing autobias to an automotive microphone system comprising the steps of:
producing an audio output using at least one microphone;
increasing the output of the audio output using an amplifier;
providing an output of the amplifier to an input of the amplifier using an alternating current (AC) feedback from an amplifier output to an amplifier input for providing amplifier stability;
providing a dynamic bias to a voltage reference using a direct current (DC) feedback path; and
adjusting the dynamic bias to the amplifier using the voltage reference depending on at least one electronic device loading the at least one microphone such that the dynamic bias provides a variable bias point for the amplifier for maintaining a substantially constant clip level of the amplifier depending on the varying load conditions of a plurality of electronic devices using the at least one microphone.

8. A method for providing autobias to an automotive microphone system as in claim 7, wherein the at least one electronic device is a cellular telephone.

9. A method for providing autobias to an automotive microphone system as in claim 7, wherein the at least one electronic device is an automotive navigation system.

10. A method for providing autobias to an automotive microphone system as in claim 7, wherein the DC feedback path includes at least one voltage divider.

11. A method tier providing autobias to an automotive microphone system as in claim 7, wherein the DC feedback path includes at least one averaging capacitor.

12. A method for providing autobias to an automotive microphone system as in claim 7, wherein the AC feedback path is to a negative input of the amplifier.

* * * * *